US012753668B2

(12) United States Patent
Grace

(10) Patent No.: US 12,753,668 B2
(45) Date of Patent: Oct. 6, 2026

(54) TWO PASS WINDOW MILLING SYSTEM THAT CAN BE DEPLOYED AND OPERATED IN ONE TRIP

(71) Applicant: Halliburton Energy Services, Inc., Houston, TX (US)

(72) Inventor: Christopher Grace, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/053,156

(22) Filed: Feb. 13, 2025

(65) Prior Publication Data

US 2026/0235008 A1 Aug. 13, 2026

(51) Int. Cl.
*E21B 29/06* (2006.01)
*E21B 7/06* (2006.01)

(52) U.S. Cl.
CPC ..... *E21B 29/06* (2013.01); *E21B 7/061* (2013.01)

(58) Field of Classification Search
CPC ..... E21B 29/06; E21B 7/061
See application file for complete search history.

(56) References Cited

U.S. PATENT DOCUMENTS 1,589,399 A * 6/1926 Kinzbach ..... E21B 7/061 166/55.3
1,615,037 A * 1/1927 Raymond ..... E21B 7/061 166/117.5
1,636,032 A * 7/1927 Abbott ..... E21B 7/061 166/55.3
2,105,722 A 1/1938 Barrett et al.
2,553,874 A * 5/1951 Spaulding ..... E21B 7/061 175/325.2
3,194,327 A 7/1965 Smithson
(Continued)

FOREIGN PATENT DOCUMENTS

EP 1222357 4/2004
WO WO-03087524 A1 * 10/2003 ..... E21B 17/1007
(Continued)

OTHER PUBLICATIONS

"U.S. Appl. No. 18/083,826 Ex Parte Quayle Action", Sep. 29, 2024, 5 pages.
(Continued)

*Primary Examiner* — James G Sayre
(74) *Attorney, Agent, or Firm* — DeLizio, Peacock, Lewin and Guerra, LLP

(57) ABSTRACT

Implementations of a system, a milling apparatus, and a method are disclosed herein. In one implementation, a system configured for use in a wellbore drilled through one or more subsurface formations comprises a whipstock including an interior guide track, a first tubular configured to pass through an outer milling body positioned in the wellbore, and a detachable milling head and guide assembly coupled to a downhole end of the first tubular, wherein the detachable milling head and guide assembly comprises a guide configured to slot into the interior guide track of the whipstock. The system further includes a drill string comprised of one or more tubulars and coupled to an uphole end of the first tubular, wherein the drill string is configured to provide rotation to the first tubular.

20 Claims, 11 Drawing Sheets

(56) References Cited

U.S. PATENT DOCUMENTS

| | | | | |
|---|---|---|---|---|
| 5,109,924 | A * | 5/1992 | Jurgens | E21B 29/06 175/391 |
| 5,474,126 | A | 12/1995 | Lynde et al. | |
| 5,551,509 | A * | 9/1996 | Braddick | E21B 29/06 175/81 |
| 6,050,334 | A * | 4/2000 | McGarian | E21B 23/01 166/117.6 |
| 6,105,675 | A | 8/2000 | Buytaert et al. | |
| 8,607,858 | B2 * | 12/2013 | McKay | E21B 7/061 166/117.5 |
| 9,874,062 | B2 | 1/2018 | Lajesic et al. | |
| 12,065,911 | B2 | 8/2024 | Lajesic | |
| 2001/0040054 | A1 | 11/2001 | Haugen et al. | |
| 2002/0170713 | A1 * | 11/2002 | Haugen | E21B 29/02 166/117.6 |
| 2003/0098152 | A1 * | 5/2003 | Kennedy | E21B 7/061 175/81 |
| 2008/0173481 | A1 | 7/2008 | Menezes et al. | |
| 2012/0222902 | A1 | 9/2012 | Alsup et al. | |
| 2012/0261193 | A1 | 10/2012 | Swadi et al. | |
| 2013/0319693 | A1 | 12/2013 | Sponchia et al. | |
| 2015/0027708 | A1 | 1/2015 | Honekamp | |
| 2015/0361764 | A1 | 12/2015 | Cronley | |
| 2016/0237770 | A1 | 8/2016 | Korf | |
| 2018/0094496 | A1 | 4/2018 | Su et al. | |
| 2018/0305994 | A1 | 10/2018 | Ford | |
| 2020/0011134 | A1 | 1/2020 | Nevlud et al. | |
| 2023/0265718 | A1 | 8/2023 | Lajesic | |
| 2023/0265719 | A1 | 8/2023 | Lajesic | |
| 2023/0265743 | A1 | 8/2023 | Lajesic | |

FOREIGN PATENT DOCUMENTS

| | | |
|---|---|---|
| WO | 2006070204 | 7/2006 |
| WO | 2012118992 | 9/2012 |
| WO | 2020163386 | 8/2020 |
| WO | 2022072860 | 4/2022 |

OTHER PUBLICATIONS

"U.S. Appl. No. 18/083,826 Non Final Office Action", Dec. 19, 2023, 14 pages.

"U.S. Appl. No. 18/083,888 Ex Parte Quayle Action", Sep. 29, 2024, 5 pages.

"U.S. Appl. No. 18/083,888 Non Final Office Action", Mar. 26, 2024, 12 pages.

"U.S. Appl. No. 18/084,010 Ex Parte Quayle Action", Jan. 5, 2024, 7 pages.

"PCT Application No. PCT/US2025/018618 International Search Report and Written Opinion", Nov. 4, 2025, 11 pages.

* cited by examiner

400

TWO PASS WINDOW MILLING SYSTEM THAT CAN BE DEPLOYED AND OPERATED IN ONE TRIP

TECHNICAL FIELD

The disclosure generally relates to wellbores formed in subsurface formations, and in particular, to downhole milling tools.

BACKGROUND

Traditional methodology for downhole milling operations may include milling a window in a downhole tubular in two trips. First, a milling machine may be run in hole and used to create an opening in the parent casing. That milling machine is then pulled out of hole (POOH). Then, a second pass milling assembly may be run in hole (RIH) and used to finish milling the window to the full gauge diameter. The milling BHA including the second pass milling assembly is then POOH. It has long been desired for a high-quality, single-trip milling system to be developed so that the window may be milled more quickly.

BRIEF DESCRIPTION OF THE DRAWINGS

Implementations of the disclosure may be better understood by referencing the accompanying drawings.

FIGS. 1-11 and the operations described herein are examples meant to aid in understanding example implementations and should not be used to limit the potential implementations or limit the scope of the claims. Some implementations may perform additional operations, fewer operations, operations in parallel or in a different order, and some operations differently.

The description that follows includes example systems, methods, techniques, and program flows that embody implementations of the disclosure. However, it is understood that this disclosure may be practiced without these specific details. In other instances, well-known instruction instances, protocols, structures, and techniques have not been shown in detail in order not to obfuscate the description.

DESCRIPTION

Example implementations may include a way to combine milling machine technology with whipstock milling technology to create a two-pass milling assembly that may deployed in a single trip into a wellbore. The two-pass milling assembly may be RIH with a two-piece milling assembly that acts as the running tool and milling machine prop shaft until the first pass milling operation is complete. Example implementations may include a two-piece milling assembly integrated with a milling machine mill head and guide assembly. Example implementations may also add a mill guide path to a conventional whipstock such that the whipstock may function as both a milling machine and a conventional milling taperface. Two-pass, as referenced above, may refer to the operations performed by the milling assembly, whereas two-piece may refer to the physical structure and/or components of the milling assembly at various stages; hence, the milling assembly may be a two-pass, two-piece milling assembly, and these terms may both be used in its description.

After the first pass milling operation, the two-piece milling assembly inner string may be removed from the milling machine mill head and guide assembly and retracted into the outer mill body to make one conventional milling BHA. The milling BHA may then be separated from the whipstock and used to make the second milling pass to complete the window and rat hole. Once the second pass milling operation is complete, the milling BHA is POOH. Presumably, the whipstock may be left in hole while lateral bore drilling and completion works are performed. The whipstock may then be POOH by conventional means (e.g., by a hydraulic running/retrieval tool (HRT), spear, die collar, overshot, etc.). The two-piece milling assembly may form a high-quality and consistent (e.g., a good exit angle that is consistently milled on every job) window in the parent casing but in half the time normally required by conventional downhole milling systems.

Example Illustrations

Figure 1:
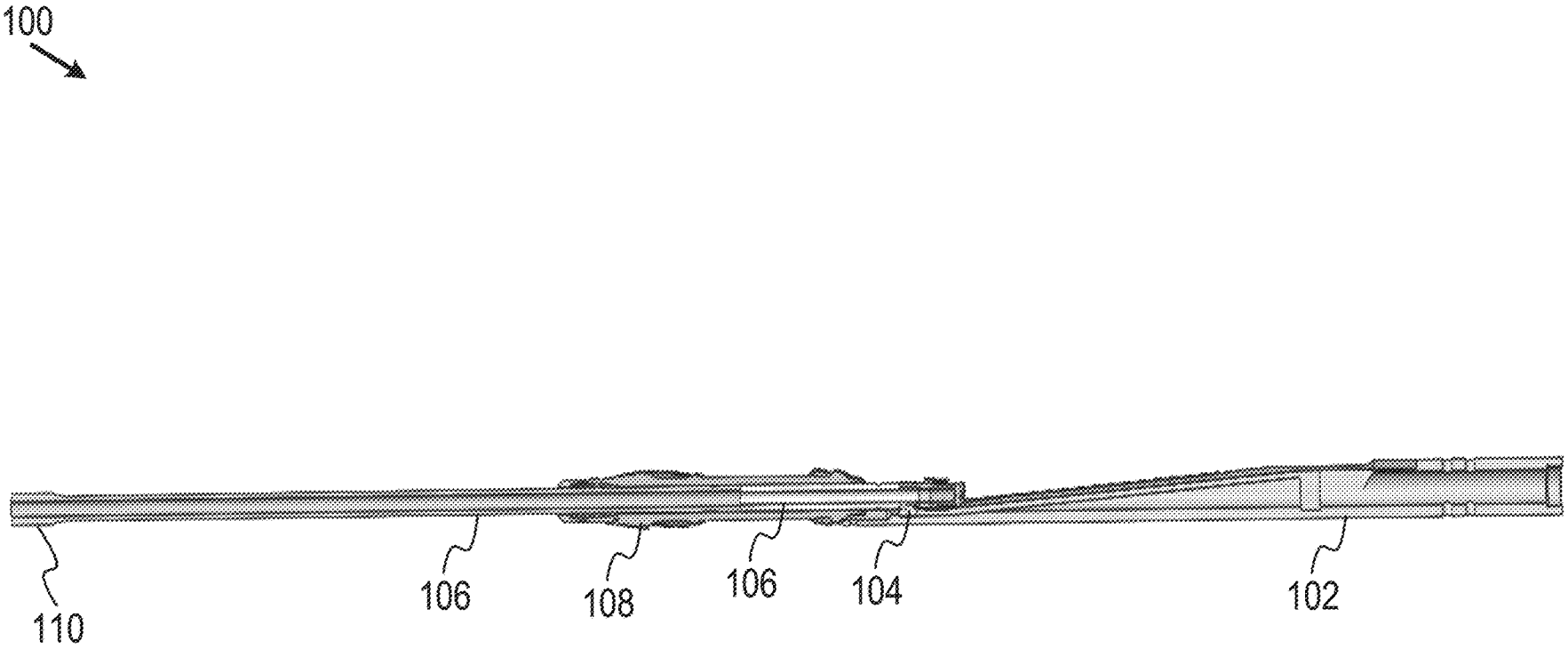
FIG. 1 is an illustration depicting a two-pass milling assembly in the RIH configuration, according to some implementations.

An example two-pass milling assembly is now described. FIG. 1 is an illustration depicting a two-pass milling assembly 100 in the RIH configuration, according to some implementations. The two-pass milling assembly 100 may be comprised of four main components including a whipstock assembly 102, milling machine mill head and guide assembly 104, an inner string 106, and an outer mill body 108. In some implementations, the whipstock assembly 102 may include a whipstock and a milling machine guide track. A coupling 110 may be used to couple an uphole end of the inner string 106 to a drill string conveyed from the surface. The two-pass milling assembly 100 may be used in any wellbore configuration including horizontal wellbores, vertical wellbores, in any number of multilateral wellbores, etc. These four main components may be described with additional detail in FIGS. 2-5.

Figure 2:
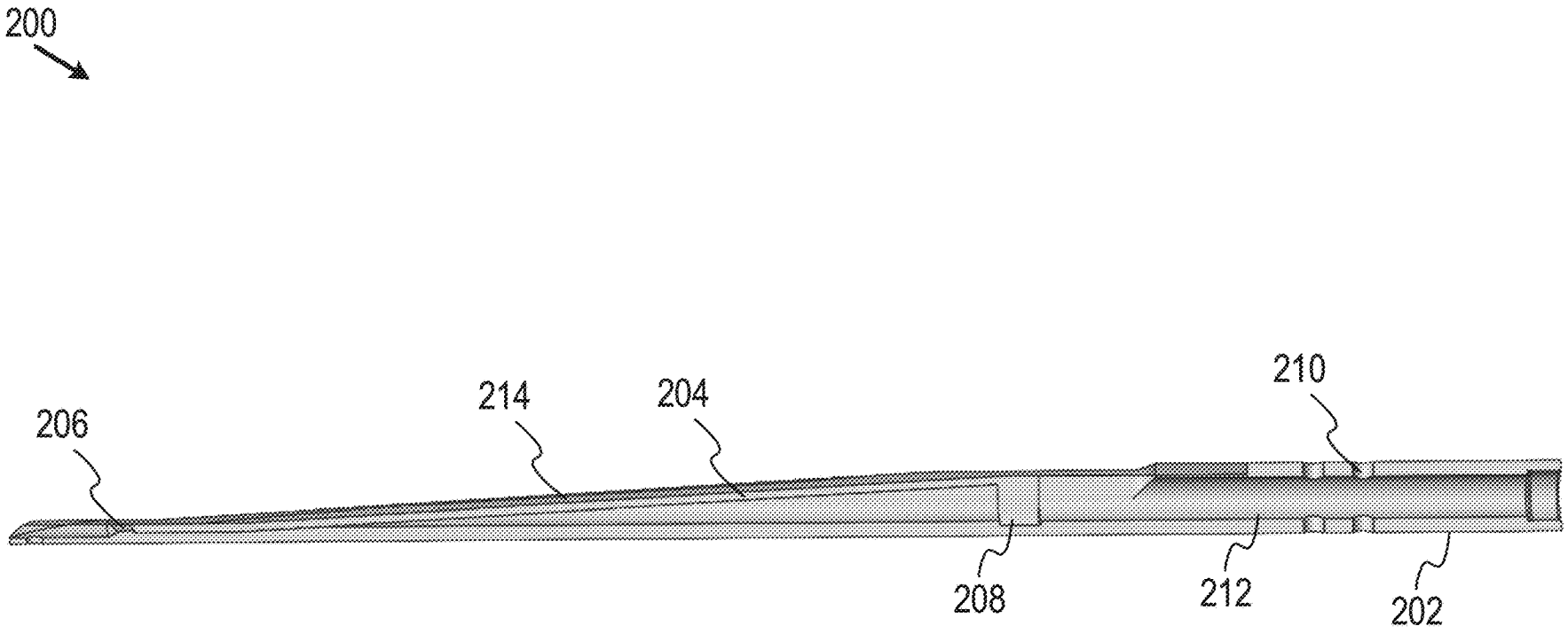
FIG. 2 is an illustration depicting the whipstock and milling machine guide track of the two-pass milling assembly, according to some implementations.

FIG. 2 is an illustration depicting the whipstock and milling machine guide track of the two-pass milling assembly 100, according to some implementations. A whipstock assembly 200 may include a whipstock 202, milling machine guide track 204, a guide track point of entry 206, a retaining section 208, one or more ports 210, and a through-bore 212. The whipstock 202 may be similar to conventional whipstock designs in that it comprises a ramped face for a mill assembly to follow. The whipstock 202 may also include a guide track 204 for a first-pass milling machine mill head and guide. The milling machine guide may enter the guide track 204 at the guide track point of entry 206. The guide track 204 may allow the milling machine mill head to follow the path of the whipstock 202 and then drop into the retaining section 208 at the downhole end of the whipstock 202.

By allowing the mill head guide to be retained in the downhole position, the inner string of the combination mill assembly may be disconnected from the milling machine mill head and guide assembly and be retracted into the outer mill body of the combination mill assembly. In some implementations, the whipstock 202 may be made from a single piece and the milling machine guide track 204 may be machined into the whipstock 202. In some implementations, the whipstock 202 may be comprised from multiple pieces that assembled together such that the complex internal geometry for the guide track 204 may be fabricated and the guide may be installed. Assembly methods may include welding, threaded fasteners, etc. As shown in FIG. 2, the whipstock 202 may be a two-piece whipstock including a primary whipstock body and a secondary whipstock body 214. In some implementations, the one or more ports 210 may allow hydraulic communication between the through-bore 212 and a wellbore to equalize a pressure with an annulus external to the whipstock 202. In some implementations, the one or more ports 210 may instead comprise one or more pockets within an internal diameter of the whipstock 202. The one or more pockets may provide a means by which a retrieval tool (e.g., an HRT) may pull the whipstock 202 out of the wellbore.

Figure 3:
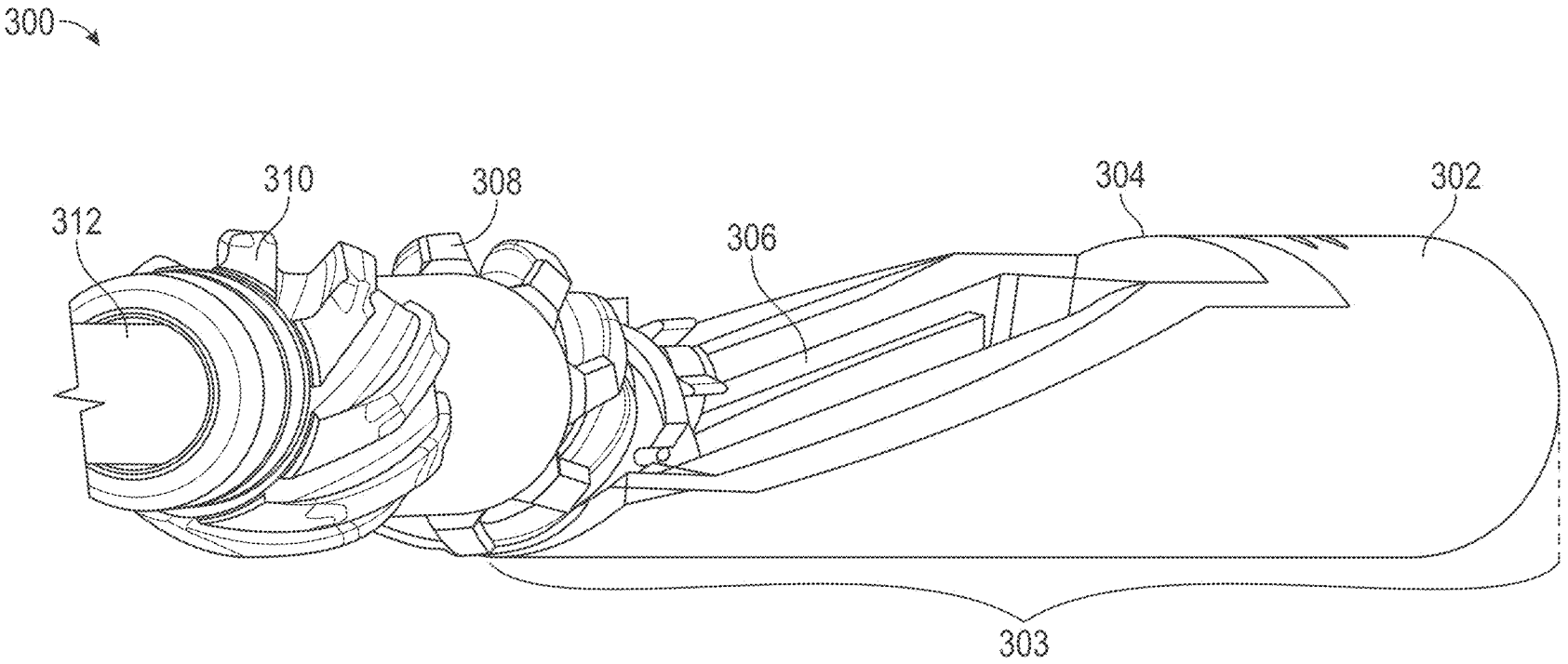
FIG. 3 is a section view depicting the whipstock assembly and outer milling body, according to some implementations.

FIG. 3 is a section view 300 depicting the whipstock assembly and outer milling body, according to some implementations. FIG. 3 includes a whipstock assembly 303 comprised of a primary whipstock body 302 and a secondary whipstock body 304, a guide track 306, an outer mill body 308, outer mill body cutters 310, and an inner string 312. As shown, the whipstock assembly 303 may be a two-piece whipstock including the primary whipstock body 302 and secondary whipstock body 304 to enclose the guide track 306. However, a one-piece, monolithic whipstock may also be used. As shown in FIG. 3, the inner string 312 and outer mill body 308 may be conveyed downhole in the RIH configuration with the whipstock assembly 303. The outer mill body 308 may include one or more outer mill body cutters 310. The outer mill body cutters 310 may be used to expand the window milled into the parent casing during a second pass milling operation.

The outer mill body 308 may be positioned in various configurations for different activities downhole. During RIH and the first pass milling operation, the inner string 312 may run through an inner diameter of the outer mill body 308 and may be free to rotate and translate through it. In the RIH configuration shown in FIG. 3, the outer mill body 308 may be fixed to the uphole end of the whipstock assembly 303 by a shear bolt or some other releasable attachment mechanism.

After the first pass milling operation is complete, the outer mill body 308 of the two-piece mill assembly may be used to drill and/or expand the window in the parent casing during the second pass milling operation. To perform this operation, torque and rotation from the inner string 312 may be transferred to the outer mill body 308 by means of a locking mechanism. For example, the outer mill body 308 may include an inner locking mechanism configured to engage with the inner string 312 after the inner string is pulled up-hole by a predetermined amount. In some implementations, the inner locking mechanism of the outer mill body 308 may include one or more spring-activated slips. When the inner string 312 is pulled up-hole by a predetermined amount, the spring activated slips may engage a spline profile on an outer diameter of the inner string 312 to lock the inner string 312 and outer mill body 308 together. At this time, the inner string 312 and outer mill body 308 may work together to mill the second pass window.

Figure 4:
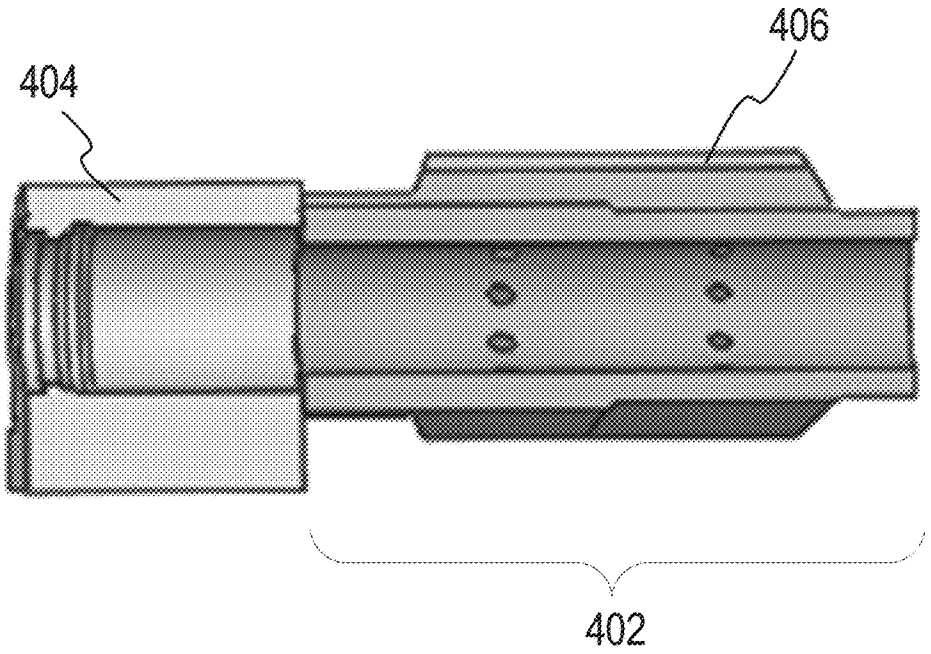
FIG. 4 is an illustration depicting a milling machine mill head and guide assembly of the two-pass milling assembly, according to some implementations.

FIG. 4 is an illustration depicting a milling machine mill head and guide assembly 400 of the two-pass milling assembly, according to some implementations. The milling machine mill head and guide assembly 400 may include a milling machine mill head 402 (also referred to as the mill head 402), a guide assembly 404, and one or more cutters 406. The milling machine mill head and guide assembly 400 may be used to mill the first pass window in the parent casing. One or more tabs extending from the guide assembly 404 may be configured to fit into the guide track 204 integrated into the whipstock 202. This mill head and guide assembly 400 may integrate with the inner string 106 of the two-piece mill assembly. Specifically, the milling machine mill head and guide assembly 400 may be configured to fit around a downhole end of the inner string 106. It is this inner string 106 of the two-piece mill assembly that may rotate the milling machine mill head 402 and push the mill head and guide assembly 400 down the milling machine guide track 204 along the angled surface of the whipstock. Specifically, the mill head 402 and cutters 406 may be configured to rotate with the inner string 106 to create an initial window within a parent casing. In some implementations, one or more bearings, such as a journal bearing, may be positioned between an inner diameter of the guide assembly 404 and outer diameter of the inner string 106. The one or more bearings may inhibit a rotation of the guide assembly 404 as the initial window within the parent casing is milled. Thus, the guide assembly 404 may remain centered within the guide track. The cutters 406 may include one or more steel blades which may include braze welded polycrystalline diamond compact (PDC) inserts, tungsten carbide inserts, etc. used to drill through a parent casing. The inner string 106 is described with additional detail in FIG. 5.

Figure 5:
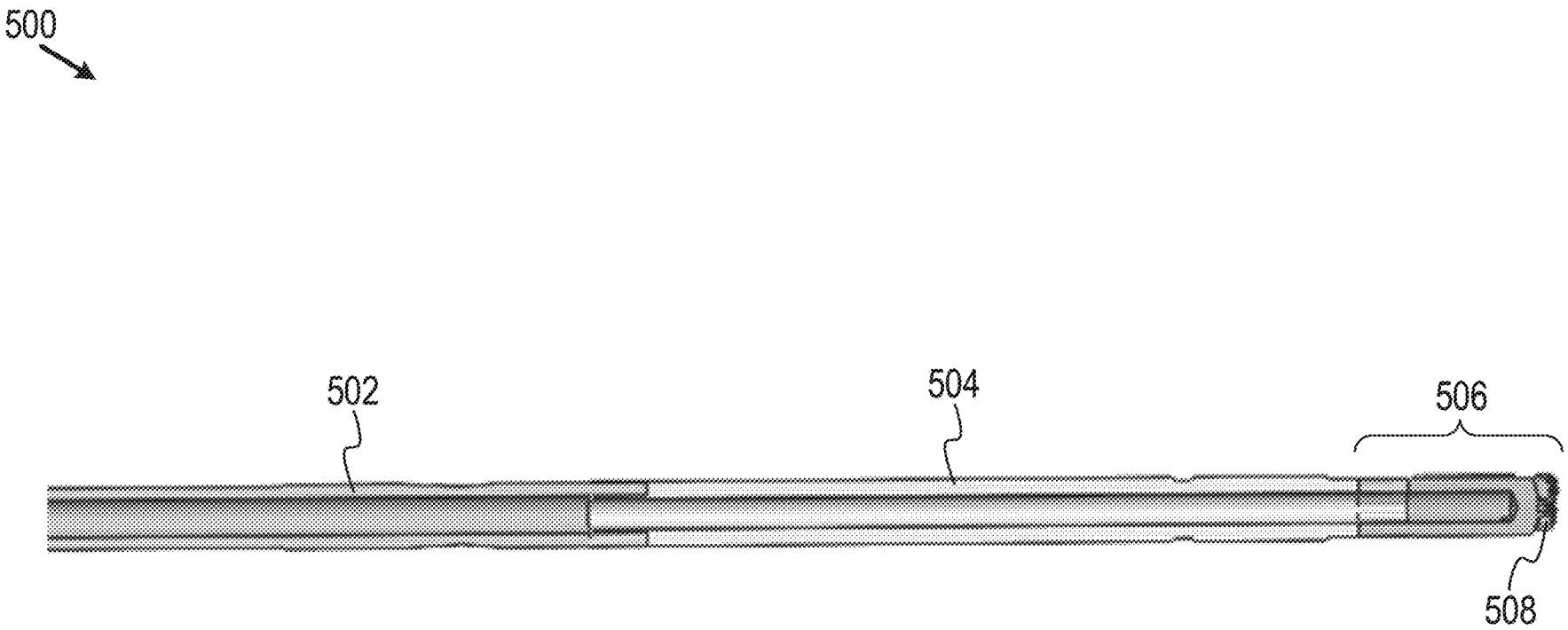
FIG. 5 is an illustration depicting the inner string of the two-pass milling assembly, according to some implementations.

FIG. 5 is an illustration depicting the inner string 500 of the two-pass milling assembly, according to some implementations. The inner string 500 may include an uphole inner string body 502, a downhole inner string body 504, a milling body 506, and a milling bit 508. The milling bit 508 may be positioned at the downhole end of the inner string 500 and may include one or more cutters.

The inner string 500 of the two-pass milling assembly may run through the inner diameter (ID) of an outer mill body, such as the outer mill body 108 of FIG. 1, and engage with the milling machine mill head and guide assembly 400. The uphole inner string body 502 of the inner string 500 may be made up to a drill string leading back to surface. The drill string may include one or more joined tubulars, one or more sections of coiled tubing, any suitable tubular configured for subsurface applications, etc. The drill string may communicate rotation, translation, and fluid communication applied from surface to the downhole environment. For example, the inner string 500 may rotate to mill a window in a parent casing via rotation applied to the drill string at the surface, the inner string 500 may translate further into or out of a wellbore via movement of the drill string. Further, drilling fluid sourced from the surface may travel through an interior of the drill string, the inner string bodies 502 and 504, and milling body 506. The drilling fluid may emerge from one or more nozzles of the milling bit 508 to lubricate the milling bit and the cutters 406 of the mill head 402.

In some implementations, the milling bit 508 may be a conventional mill head positioned at a downhole end of the inner string 500. Some implementations of the milling bit 508 may include one or more cutters comprised of brazed composite with PDC milling inserts. However, other cutter types may also be used. The milling bit 508 and the cutters 406 (when the mill head is attached) may be used to mill the window in the parent casing in both the first and second pass operations. This inner string 500 may function as the milling machine prop shaft for the first pass milling operation.

First Example Method of Operations

Figure 6:
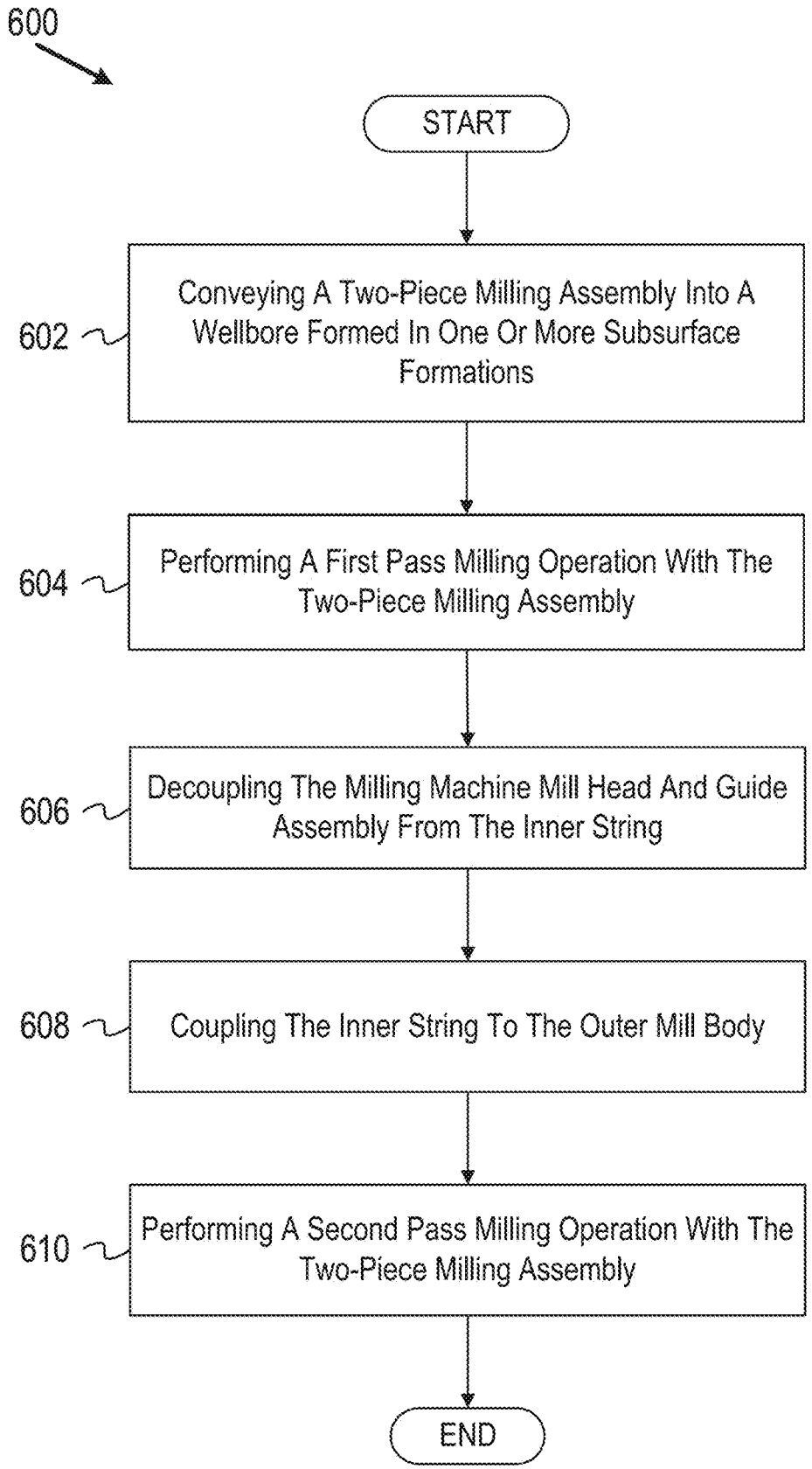
FIG. 6 is a flowchart depicting a first example method of operations, according to some implementations.

FIG. 6 is a flowchart depicting an example method of operations, according to some implementations. Operations of a method 600 may be performed by software, firmware, hardware, or a combination thereof. Such operations are described with reference to FIGS. 1-5 and 7-10. However, such operations may be performed by other systems or components. The operations of the method 600 begin at block 602.

Figure 7A:
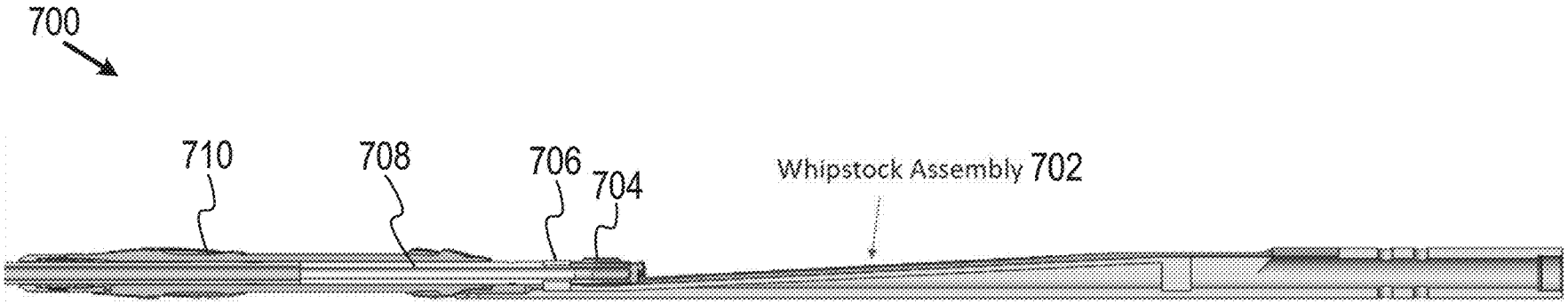
FIGS. 7A-7B are illustrations depicting the two-piece milling assembly run in hole, according to some implementations.
Figure 7B:
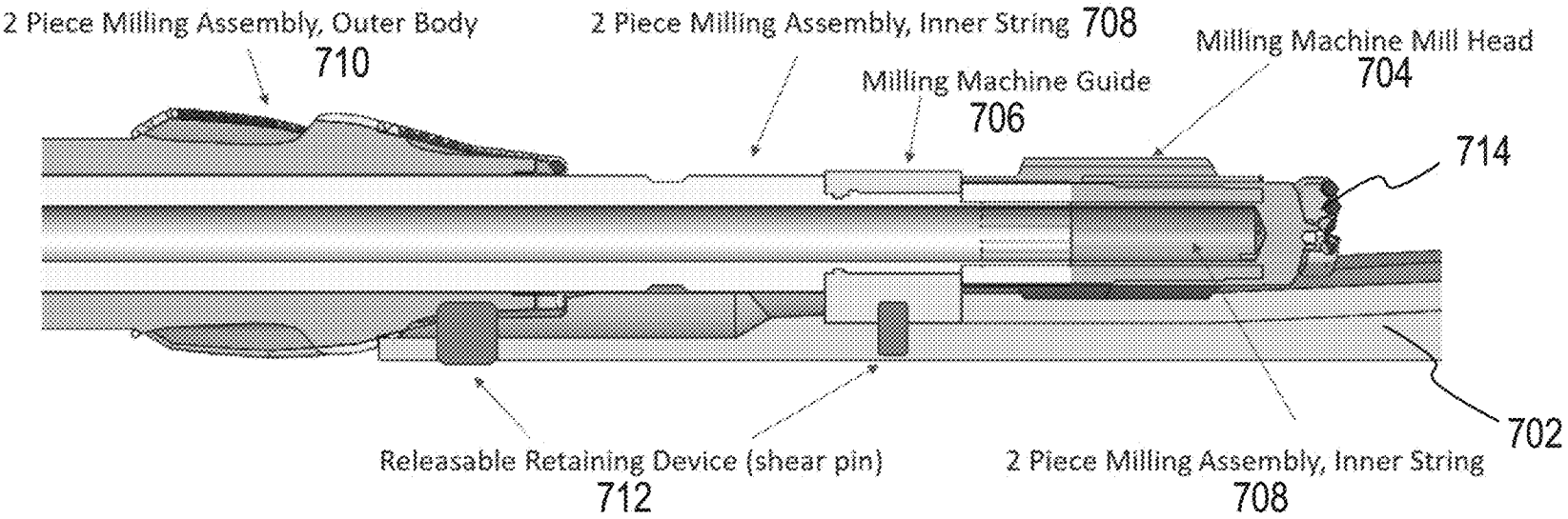

At block 602, the method 600 includes conveying a two-piece milling assembly into a wellbore formed in one or more subsurface formations. This may be described with reference to FIGS. 7A-7B. FIGS. 7A-7B are illustrations depicting the two-piece milling assembly run in hole, according to some implementations. As shown, the two-piece milling assembly 700 may include a milling assembly including a milling machine mill head 704, milling machine guide 706, a two-piece milling assembly inner string 708 ("inner string 708"), and a two-piece milling assembly outer mill body 710 ("outer mill body 710") may be run in hole (RIH) coupled to a whipstock assembly 702. During RIH, the two-piece milling assembly inner string 708 may be positioned inside the outer mill body 710 and attached at the downhole end (i.e., the end proximate to the milling bit 714) to the milling machine mill head 704 and milling machine guide 706. The outer mill body 710 may be attached to the uphole end of the whipstock assembly 702 via a releasable retaining device 712. In some implementations, the releasable retaining device 712 may include one or more shear bolts, shear pins, latch release mechanisms, etc., although other releasable retaining devices and techniques may also be used. During RIH, the outer mill body 710 may be coupled to the whipstock assembly 702 via the releasable retaining device(s) 712. Therefore, the outer mill body 710 may not be free to move relative to the whipstock. The milling machine guide 706 may also releasably attached to the up-hole end of the whipstock assembly 702 via a releasable retaining device 712, such as a shear pin. The milling machine guide 706 may be retained inside a guide slot that is integral to the whipstock. This guide slot may be similar to the guide track 306 of FIG. 3. Below the whipstock assembly 702, a latching mechanism may be used to locate and orient the whipstock assembly 702 adjacent to a desired window location in the parent casing. The entire two-piece milling assembly including the whipstock assembly 702, milling machine mill head 704, milling machine guide 706, inner string 708 including the milling bit 714, outer mill body 710, releasable retaining devices 712, etc. may be RIH on drill pipe, coiled tubing, or similar conveyance means. Flow progresses to block 604.

Figure 8:
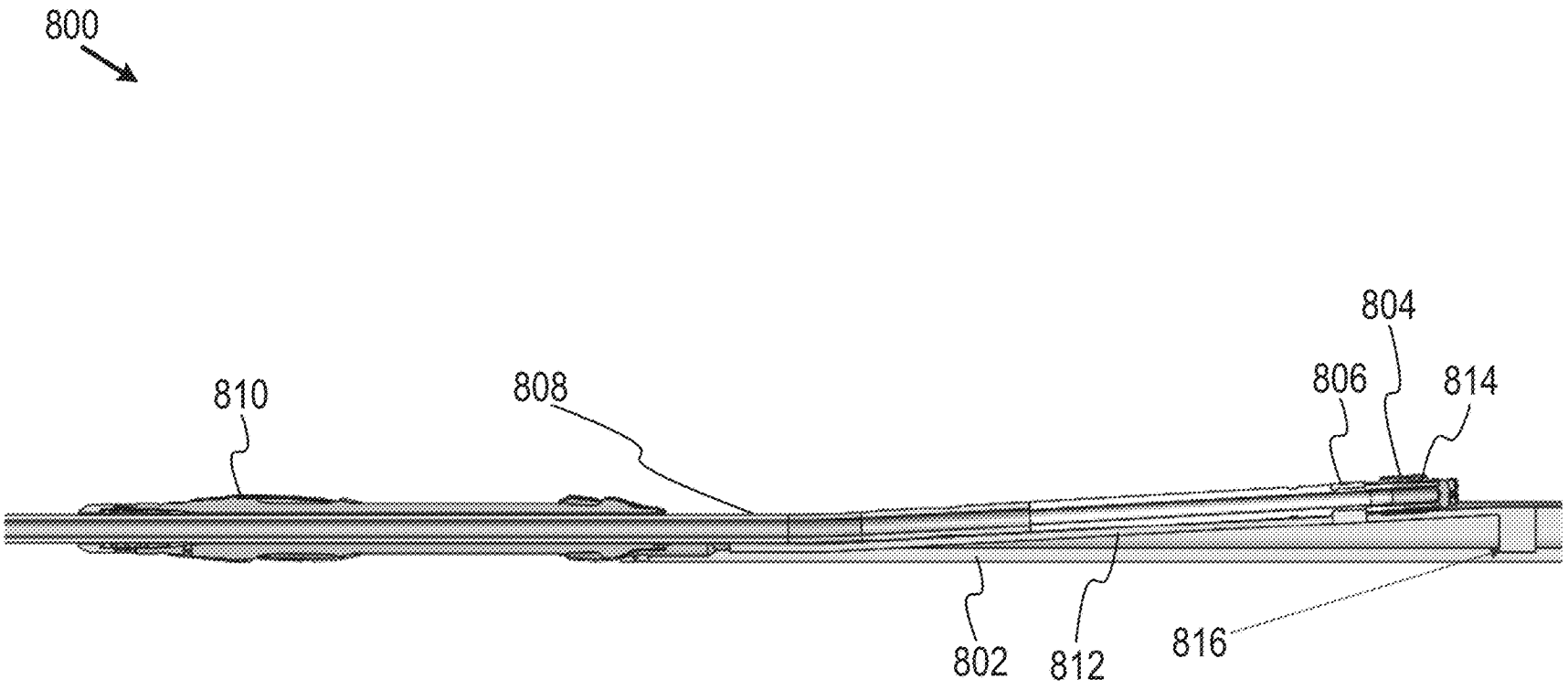
FIG. 8 is an illustration depicting a first pass milling operation with the milling machine, according to some implementations.

At block 604, the method 600 includes performing a first pass milling operation with the two-piece milling assembly. This first pass milling operation may be described with reference to FIG. 8. FIG. 8 is an illustration 800 depicting a first pass milling operation with the milling machine, according to some implementations. FIG. 8 includes a whipstock assembly 802, mill head 804, mill guide 806, inner string 808, outer mill body 810, guide track 812, milling bit 814, and retention slot 816. Once the whipstock assembly 802 is located and oriented, a user may mill a first pass window. A rig located at the surface may begin rotating the drill string and two-piece mill assembly inner string 808 and set down weight to free the milling machine mill head 804 and mill guide 806. This weight may, for example, separate the mill head 804 from a releasable retaining device similar to the releasable retaining device 712. The mill head and guide assembly may follow the guide track 812 in the whipstock to mill a slot in a tubular such as a casing (e.g., a first pass window). As the mill assembly comprised of the inner string 808, mill head 804, mill guide 806, and milling bit 814 travels downhole, the mill assembly may travel relative to the whipstock assembly 802, following the whipstock profile. During this process, the two-piece mill assembly outer mill body 810 may not move and may remain attached to the whipstock tip, as shown in FIG. 8.

Figure 9:
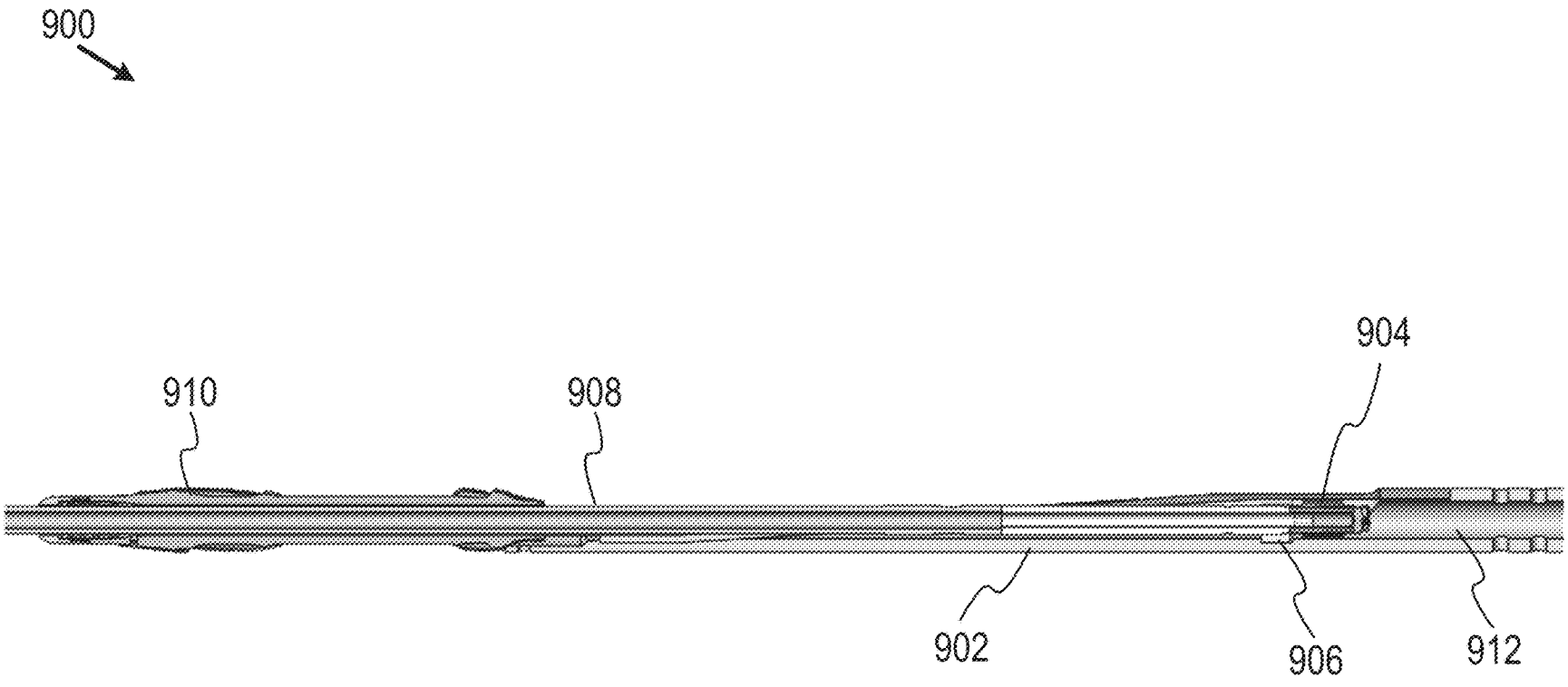
FIG. 9 is an illustration depicting the first pass milling operation of the milling machine as it reaches a final depth, according to some implementations.

At least a portion of the first pass milling operation may be described with reference to FIG. 9. FIG. 9 is an illustration 900 depicting the first pass milling operation of the milling machine as it reaches a final depth, according to some implementations. FIG. 9 includes the whipstock 902, milling machine mill head 904, milling machine guide 906, inner string 908, outer mill body 910, and through-bore 912. Once the first pass milling machine of FIG. 8 reaches a final depth and has completed the first pass window in the parent casing, the milling machine guide 906 may drop into the retaining slot in the whipstock 902. Once in the retaining slot, milling machine guide 906 may not translate up-hole or down hole. At least a portion of the inner string 908 may fall into a hollow bore of the whipstock 902 when the milling machine mill head 904 and guide 906 fall into the retaining slot. The milling machine mill head 904 and milling machine guide 906 may drop down into a recess in the whipstock 902 such that these components do not prevent the whipstock 902 from being retrieved in later operational steps. When the mill head 904 and guide 906 drop into the retention slot, the first pass milling operation may be complete. The slot formed into the parent casing during the first pass milling operation may not comprise a desired diameter until after the second pass milling operation. However, this slot formed during the first pass may control an exit angle of the outer mill body during the second pass. Flow progresses to block 606.

At block 606, the method 600 includes decoupling the milling machine mill head and guide assembly from the inner string. Decoupling the milling machine mill head and guide assembly from the inner string may also be described with reference to FIG. 9. To decouple the mill head 904 and guide 906 (comprising the milling machine mill head and guide assembly) from the inner string 908, the drill string may be pulled upward to deactivate one or more release mechanisms coupling the mill head 904 and guide 906 to the inner string 908. For example, pulling upward on the drill string may shear one or more shear pins to separate the inner string 908 of the two-piece milling assembly from the milling machine mill head 904 and guide 906. In some implementations, the release mechanism used to couple the milling machine mill head and guide assembly to the inner string 908 may include any number of shear devices, pressure activated release mechanisms, torque activated release mechanisms, latch release mechanisms, etc. Flow progresses to block 608.

Figure 10:
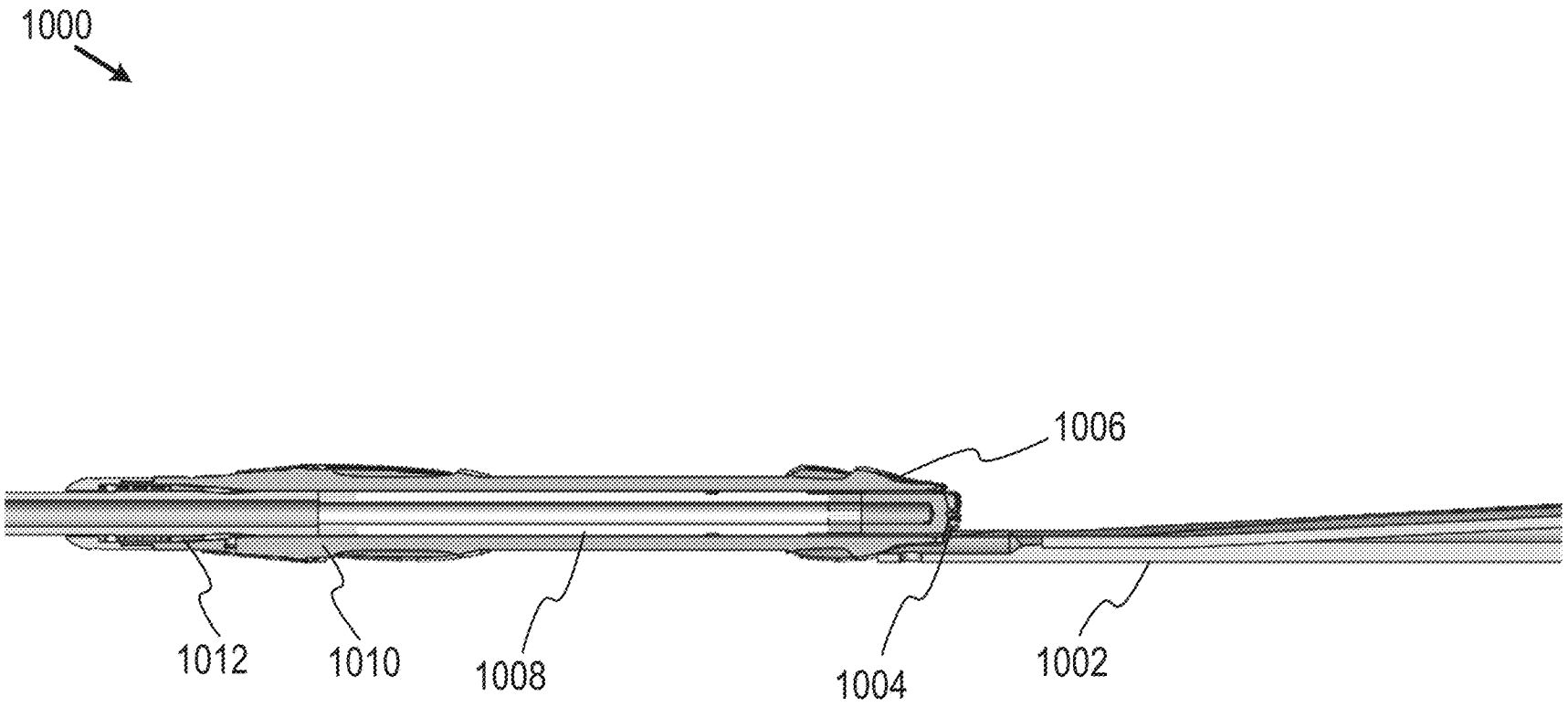
FIG. 10 is an illustration depicting the two-piece milling assembly as it is retracted uphole and configured for a second pass milling operation, according to some implementations.

At block 608, the method 600 includes coupling the inner string to the outer mill body. Coupling the inner string to the outer mill body may be described with reference to FIG. 10. FIG. 10 is an illustration 1000 depicting the two-piece milling assembly as it is retracted uphole and configured for a second pass milling operation, according to some implementations. FIG. 10 includes the whipstock 1002, milling bit 1004, outer mill head 1006, inner string 1008, and an outer mill body 1010 including a locking mechanism 1012. After decoupling the inner string 1008 and milling machine head and guide assembly, the inner string 1008 may be retracted out of the whipstock 1002, and the milling machine head and guide assembly may remain within the retention slot of the whipstock 1002. The milling machine head and guide assembly may be recovered when the whipstock is retrieved from the wellbore.

Once freed, the inner string 1008 of the two-piece milling assembly may be pulled uphole until it locks into the outer mill body 1010. The locking mechanism 1012 may be positioned along an inner diameter (ID) of the outer mill body 1010. The locking mechanism may be configured to lock with features disposed along an outer diameter (OD) of at least a portion of the inner string 1008. In some implementations, a spring-loaded slip assembly positioned along the ID of the outer mill body 1010 may engage one or more splined features positioned along the OD of the inner string 1008 to couple the two pieces together. At this point, the two-piece mill assembly may behave as a single assembly, and axial and rotational inputs from the drill string may now be communicated to the total two-piece mill assembly. For example, the locking mechanism 1012 may engage with the inner string 1008 such that axial, rotational, and torsional inputs to the drill string and inner string 1008 are transferred to the outer mill body 1010. Flow progresses to block 610.

At block 610, the method 600 includes performing a second pass milling operation with the two-piece milling assembly. With reference to FIG. 10, the driller at the surface may set down weight to shear the outer mill body 1010 from the uphole end of the whipstock 1002, freeing the outer mill body 1010 to perform the second pass milling operation. Rotation and weight may be applied to the inner string 1008 and outer mill body 1010 to mill the second pass window. The second pass window may be milled by one or more cutters of the outer mill body 1010. In some implementations, the milling bit 1004 may also aid in the milling of the second pass window. The outer mill body 1010 may be used to expand the first pass window in the parent casing to a final gauge diameter during the second pass milling operation. The two-piece milling assembly may form a consistent window in a target tubular through the first pass and second pass milling operations. The milled window may comprise a repeatable exit angle (e.g., between two and three degrees relative to the parent wellbore) that may be consistently milled on each job without pulling out of hole. This milled window may be the beginning of a new lateral bore to be drilled out and completed later. Flow of the method 600 ceases.

Second Example Method of Operations

Figure 11:
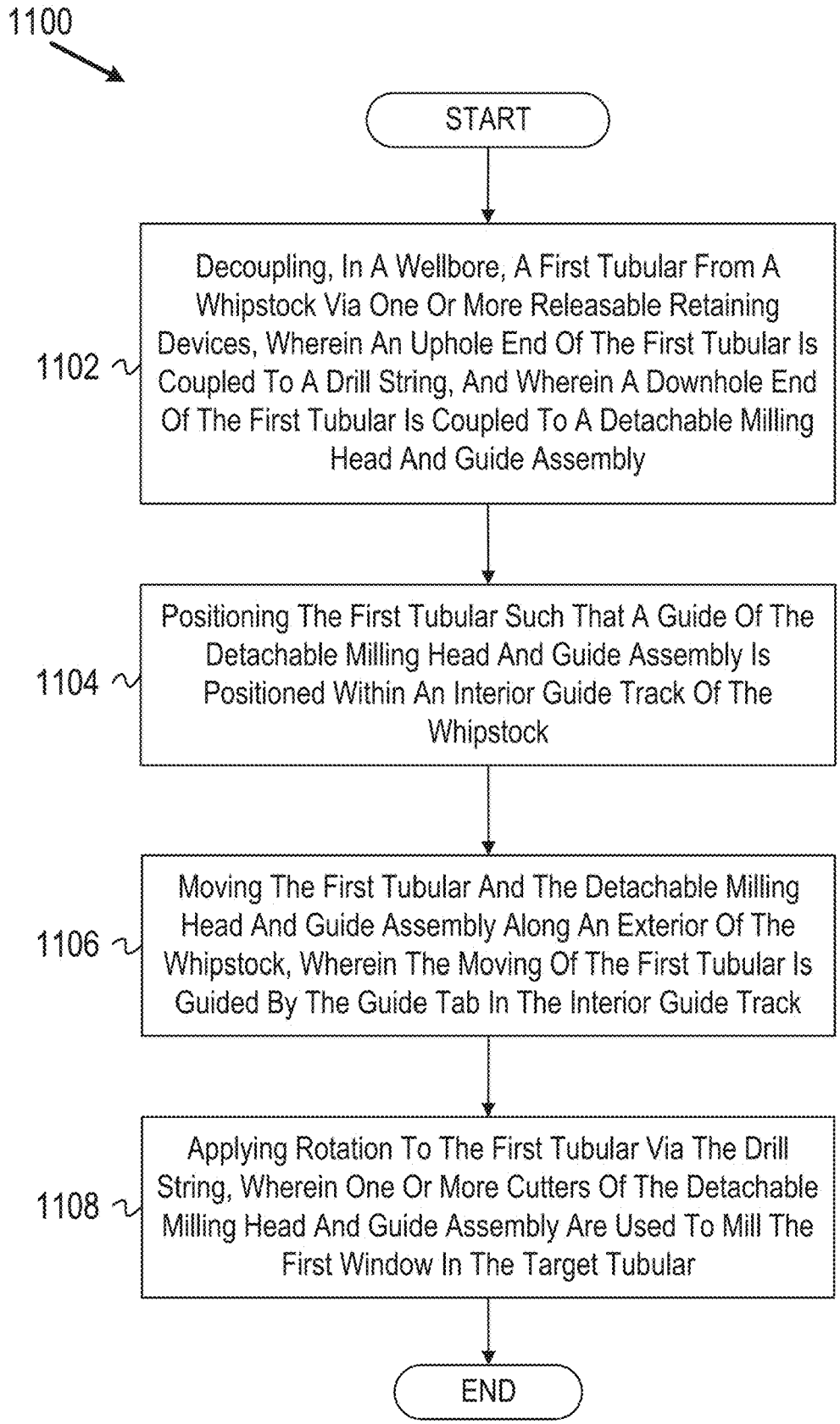
FIG. 11 is a flowchart depicting a second example method of operations, according to some implementations.

FIG. 11 is a flowchart depicting a second example method of operations, according to some implementations. Operations of a method 1100 may be performed by software, firmware, hardware, or a combination thereof. Such operations are described with reference to FIGS. 1-10. However, such operations may be performed by other systems or components. The operations of the method 1100 may relate to performing, using a milling assembly, a milling operation to mill a first window into a target tubular via a single trip into a wellbore formed in one or more subsurface formations. The operations of the method 1100 begin at block 1102.

At block 1102, the method 1100 includes decoupling, in a wellbore, a first tubular from a whipstock via one or more releasable retaining devices, wherein an uphole end of the first tubular is coupled to a drill string, and wherein a downhole end of the first tubular is coupled to a detachable milling head and guide assembly. For example, with reference to FIG. 7, the inner string 708 may be decoupled from an uphole end of the whipstock assembly 702 via the releasable retaining devices 712. An uphole end of the inner string 708 may be coupled to a drill string, and a downhole end of the inner string 708 may be coupled to the milling machine mill head 704 and milling machine guide 706. Flow progresses to block 1104.

At block 1104, the method 1100 includes positioning the first tubular such that a guide of the detachable milling head and guide assembly is positioned within an interior guide track of the whipstock. For example, with reference to FIG. 8, the inner string 808 may be positioned such that the mill guide 806 resides within the guide track 812. As weight is applied from the surface, the inner string 808 may move along an exterior taperface of the whipstock assembly 802 according to the path of the guide track 812. The guide track 812 may enable the mill head 804 to mill a consistent window in a target tubular at a predefined exit angle during a first pass milling operation. This target tubular may, for example, include a parent casing of a wellbore in which the whipstock assembly 802, inner string 808, outer mill body 810, etc. are conveyed into. However, other tubulars may also be the target of downhole milling operations. Flow progresses to block 1106.

At block 1106, the method 1100 includes moving the first tubular and the detachable milling head and guide assembly along an exterior of the whipstock, wherein the moving of the first tubular is guided by the guide in the interior guide track. Flow progresses to block 1108.

At block 1108, the method 1100 includes applying rotation to the first tubular via the drill string, wherein one or more cutters of the detachable milling head and guide assembly are used to mill the first window into the target tubular. For example, with reference to FIG. 8, torque, rotation, and weight may be applied from the surface to a drill string coupled to an uphole end of the inner string 808. This may cause the inner string 808 to rotate and travel along the taperface of the whipstock assembly 802. One or more cutters of the mill head 804 may be used to mill an initial entry window through a target tubular during a first pass milling operation. This initial window may be expanded to a final gauge via the outer mill body 810 during the second pass milling operation. Flow of the method 1100 ceases.

EXAMPLE IMPLEMENTATIONS

Example implementations include the following:

Implementation #1: A system configured for use in a wellbore drilled through one or more subsurface formations, the system comprising: a whipstock including an interior guide track; a first tubular configured to pass through an outer milling body positioned in the wellbore; a detachable milling head and guide assembly coupled to a downhole end of the first tubular, wherein the detachable milling head and guide assembly comprises a guide configured to slot into the interior guide track of the whipstock; and a drill string comprised of one or more tubulars and coupled to an uphole end of the first tubular, wherein the drill string is configured to provide rotation to the first tubular.

Implementation #2: The system of Implementation 1, wherein the detachable milling head and guide assembly is coupled to the first tubular when the first tubular is conveyed into the wellbore, and wherein an uphole end of the whipstock is coupled to the downhole end of the first tubular via one or more releasable retaining devices when the whipstock, the first tubular, and the detachable milling head and guide assembly are conveyed into the wellbore.

Implementation #3: The system of any one or more of Implementations 1-2, wherein the detachable milling head and guide assembly comprises: a milling head including one or more cutters, wherein the rotation of the first tubular rotates the milling head to mill a first window into a target tubular; a guide assembly including the guide, wherein a movement of the first tubular is guided by the guide within the interior guide track; and one or more bearings coupled to an inner diameter of the guide assembly, wherein the one or more bearings prevent a rotation of the guide assembly.

Implementation #4: The system of any one or more of Implementations 1-3, wherein the whipstock further comprises: a retaining section positioned at a downhole end of the interior guide track, wherein the first tubular and the detachable milling head and guide assembly are configured to move along an exterior of the whipstock to mill a first window into a target tubular, wherein at least a portion of the first tubular and the detachable milling head and guide assembly are configured to fall into the retaining section of the whipstock after the first window is milled.

Implementation #5: The system of any one or more of Implementations 1-4, wherein the detachable milling head and guide assembly is configured to detach from the first tubular as the first tubular is pulled from the retaining section of the whipstock.

Implementation #6: The system of any one or more of Implementations 1-5, wherein the first tubular is configured to couple with the outer milling body such that torque and rotation applied to the first tubular is also applied to the outer milling body, wherein the first tubular coupled to the outer milling body is configured to expand a first window milled into a target tubular.

Implementation #7: A milling apparatus configured for use in a wellbore formed in one or more subsurface formations, the milling apparatus comprising: a whipstock including an interior guide track; a first tubular configured to pass through an outer milling body positioned in the wellbore; and a detachable milling head and guide assembly coupled to a downhole end of the first tubular, wherein the detachable milling head and guide assembly comprises a guide configured to slot into the interior guide track of the whipstock.

Implementation #8: The milling apparatus of Implementation 7, further comprising: a drill string comprised of one or more tubulars and coupled to an uphole end of the first tubular, wherein the drill string is configured to provide rotation to the first tubular.

Implementation #9: The milling apparatus of any one or more of Implementations 7-8, wherein the detachable milling head and guide assembly comprises: a milling head including one or more cutters, wherein a rotation of the first tubular rotates the milling head to mill a first window into a target tubular; a guide assembly including the guide, wherein a movement of the first tubular is guided by the guide within the interior guide track; and one or more bearings coupled to an inner diameter of the guide assembly, wherein the one or more bearings prevent a rotation of the guide assembly.

Implementation #10: The milling apparatus of any one or more of Implementations 7-9, wherein the whipstock further comprises: a retaining section positioned at a downhole end of the interior guide track, wherein the first tubular and the detachable milling head and guide assembly are configured to move along an exterior of the whipstock to mill a first window into a target tubular, wherein at least a portion of the first tubular and the detachable milling head and guide assembly are configured to fall into the retaining section of the whipstock after the first window is milled.

Implementation #11: The milling apparatus of any one or more of Implementations 7-10, wherein the detachable milling head and guide assembly is configured to detach from the first tubular as the first tubular is pulled from the retaining section of the whipstock.

Implementation #12: The milling apparatus of any one or more of Implementations 7-11, wherein the first tubular is configured to couple with the outer milling body such that torque and rotation applied to the first tubular is also applied to the outer milling body, wherein the first tubular coupled to the outer milling body is configured to expand a first window milled into a target tubular.

Implementation #13: A method comprising: performing, using a milling assembly, a milling operation to mill a first window into a target tubular via a single trip into a wellbore formed in one or more subsurface formations, wherein performing the milling operation includes, decoupling, in the wellbore, a first tubular from a whipstock via one or more releasable retaining devices, wherein an uphole end of the first tubular is coupled to a drill string, and wherein a downhole end the first tubular is coupled to a detachable milling head and guide assembly, positioning the first tubular such that a guide of the detachable milling head and guide assembly is positioned within an interior guide track of the whipstock, moving the first tubular and the detachable milling head and guide assembly along an exterior of the whipstock, wherein the moving of the first tubular is guided by the guide in the interior guide track, and applying rotation to the first tubular via the drill string, wherein one or more cutters of the detachable milling head and guide assembly are used to mill the first window into the target tubular.

Implementation #14: The method of Implementation 13, further comprising: conveying the milling assembly into the wellbore, wherein the milling assembly comprises the whipstock, the first tubular, an outer milling body, and the detachable milling head and guide assembly, wherein at least a portion of the first tubular is configured to pass through the outer milling body.

Implementation #15: The method of any one or more of Implementations 13-14, further comprising: inhibiting a rotation of the guide assembly while the first tubular is rotating via one or more bearings positioned between an outer diameter of the first tubular and an inner diameter of a guide assembly, wherein the guide assembly comprises the guide.

Implementation #16: The method of any one or more of Implementations 13-15, further comprising: positioning the first tubular and the detachable milling head and guide assembly within a retaining section of the whipstock; and pulling the first tubular from the retaining section to decouple the first tubular from the detachable milling head and guide assembly.

Implementation #17: The method of any one or more of Implementations 13-16, further comprising: coupling the first tubular to an outer milling body including one or more cutters, wherein the first tubular is configured to couple with the outer milling body such that torque and rotation applied to the first tubular is also applied to the outer milling body.

Implementation #18: The method of any one or more of Implementations 13-17, further comprising: moving the first tubular and the outer milling body, once coupled, along the exterior of the whipstock.

Implementation #19: The method of any one or more of Implementations 13-18, further comprising: applying rotation, via the drill string, to the first tubular, wherein the first tubular functions as a driveshaft for the outer milling body; and expanding the first window in the target tubular via the outer milling body.

Implementation #20: The method of any one or more of Implementations 13-19, further comprising: retrieving the whipstock from the wellbore, wherein the detachable milling head and guide assembly are positioned within a retaining section of the whipstock.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable sub-combination. Moreover, although features may be described as acting in certain combinations and even initially claimed as such, one or more features from a claimed combination may in some cases be excised from the combination, and the claimed combination may be directed to a sub-combination or variation of a sub-combination.

While operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. Moreover, the separation of various system components in the implementations described should not be understood as requiring such separation in all implementations. Additionally, other implementations are within the scope of the following claims. In some cases, the actions recited in the claims may be performed in a different order and still achieve desirable results.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed. Similarly, "at least one of: a, b, or c" is intended to cover: a, b, c, a-b, a-c, b-c, and a-b-c.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well may be horizontal or even slightly directed upwards. Unless otherwise specified, use of the terms "subsurface formation" or "subterranean formation" shall be construed as encompassing both areas below exposed earth and areas below earth covered by water such as ocean or fresh water.

What is claimed is:

1. A system configured for use in a wellbore drilled through one or more subsurface formations, the system comprising:

a whipstock including an interior guide track, wherein the interior guide track is distinct from a taper face of the whipstock;

a first tubular configured to pass through an outer milling body positioned in the wellbore;

a milling head and guide assembly coupled to a downhole end of the first tubular, wherein the milling head and guide assembly comprises a guide configured to slot into the interior guide track of the whipstock; and a retaining section positioned at a downhole end of the interior guide track and configured to receive the milling head and guide assembly.

2. The system of claim 1, wherein the milling head and guide assembly is coupled to the first tubular when the first tubular is conveyed into the wellbore, and wherein an uphole end of the whipstock is coupled to the downhole end of the first tubular via one or more releasable retaining devices when the whipstock, the first tubular, and the milling head and guide assembly are conveyed into the wellbore.

3. The system of claim 1, wherein the milling head and guide assembly comprises:

a milling head including one or more cutters, wherein a rotation of the first tubular rotates the milling head to mill a first window into a target tubular;

a guide assembly including the guide, wherein a movement of the first tubular is guided by the guide within the interior guide track; and one or more bearings coupled to an inner diameter of the guide assembly, wherein the one or more bearings prevent a rotation of the guide assembly.

4. The system of claim 1, wherein the first tubular and the milling head and guide assembly are configured to move along an exterior of the whipstock to mill a first window into a target tubular, and wherein at least a portion of the first tubular and the milling head and guide assembly are configured to fall into the retaining section of the whipstock after the first window is milled.

5. The system of claim 1, wherein the milling head and guide assembly is configured to detach from the first tubular as the first tubular is pulled from the retaining section of the whipstock.

6. The system of claim 1, further comprising:

a drill string comprised of one or more tubulars and coupled to an uphole end of the first tubular, wherein the drill string is configured to provide rotation to the first tubular, wherein the first tubular is configured to couple with the outer milling body such that torque and rotation applied to the first tubular is also applied to the outer milling body, wherein the first tubular coupled to the outer milling body is configured to expand a first window milled into a target tubular.

7. A milling apparatus configured for use in a wellbore formed in one or more subsurface formations, the milling apparatus comprising:

a whipstock including an interior guide track, wherein the interior guide track is distinct from a taper face of the whipstock;

a first tubular configured to pass through an outer milling body positioned in the wellbore;

a milling head and guide assembly coupled to a downhole end of the first tubular, wherein the milling head and guide assembly comprises a guide configured to slot into the interior guide track of the whipstock; and a retaining section positioned at a downhole end of the interior guide track and configured to receive the milling head and guide assembly.

8. The milling apparatus of claim 7, further comprising:

a drill string comprised of one or more tubulars and coupled to an uphole end of the first tubular, wherein the drill string is configured to provide rotation to the first tubular.

9. The milling apparatus of claim 7, wherein the milling head and guide assembly comprises:

a milling head including one or more cutters, wherein a rotation of the first tubular rotates the milling head to mill a first window into a target tubular;

a guide assembly including the guide, wherein a movement of the first tubular is guided by the guide within the interior guide track; and one or more bearings coupled to an inner diameter of the guide assembly, wherein the one or more bearings prevent a rotation of the guide assembly.

10. The milling apparatus of claim 7, wherein the first tubular and the milling head and guide assembly are configured to move along an exterior of the whipstock to mill a first window into a target tubular, and wherein at least a portion of the first tubular and the milling head and guide assembly are configured to fall into the retaining section of the whipstock after the first window is milled.

11. The milling apparatus of claim 7, wherein the milling head and guide assembly is configured to detach from the first tubular as the first tubular is pulled from the retaining section of the whipstock.

12. The milling apparatus of claim 7, wherein the first tubular is configured to couple with the outer milling body such that torque and rotation applied to the first tubular is also applied to the outer milling body, wherein the first tubular coupled to the outer milling body is configured to expand a first window milled into a target tubular.

13. A method comprising:

performing, using a milling assembly, a milling operation to mill a first window into a target tubular via a single trip into a wellbore formed in one or more subsurface formations, wherein performing the milling operation includes, decoupling, in the wellbore, a first tubular from a whipstock via one or more releasable retaining devices, wherein an uphole end of the first tubular is coupled to a drill string, and wherein a downhole end of the first tubular is coupled to a milling head and guide assembly, positioning the first tubular such that a guide of the milling head and guide assembly is positioned within an interior guide track of the whipstock, wherein the interior guide track is distinct from a taper face of the whipstock, moving the first tubular and the milling head and guide assembly along an exterior of the whipstock, wherein the moving of the first tubular is guided by the guide in the interior guide track, and applying rotation to the first tubular via the drill string, wherein one or more cutters of the milling head and guide assembly are used to mill the first window into the target tubular.

14. The method of claim 13, further comprising:

conveying the milling assembly into the wellbore, wherein the milling assembly comprises the whipstock, the first tubular, an outer milling body, and the milling head and guide assembly, wherein at least a portion of the first tubular is configured to pass through the outer milling body.

15. The method of claim 13, further comprising:

inhibiting a rotation of the guide assembly while the first tubular is rotating via one or more bearings positioned between an outer diameter of the first tubular and an inner diameter of a guide assembly, wherein the guide assembly comprises the guide.

16. The method of claim 13, further comprising:

positioning the first tubular and the milling head and guide assembly within a retaining section of the whipstock; and pulling the first tubular from the retaining section to decouple the first tubular from the milling head and guide assembly.

17. The method of claim 16, further comprising:

coupling the first tubular to an outer milling body including one or more cutters, wherein the first tubular is configured to couple with the outer milling body such that torque and rotation applied to the first tubular is also applied to the outer milling body.

18. The method of claim 17, further comprising:

moving the first tubular and the outer milling body, once coupled, along the exterior of the whipstock.

19. The method of claim 17, further comprising:

applying rotation, via the drill string, to the first tubular, wherein the first tubular functions as a driveshaft for the outer milling body; and expanding the first window in the target tubular via the outer milling body.

20. The method of claim 13, further comprising:

retrieving the whipstock from the wellbore, wherein the milling head and guide assembly are positioned within a retaining section of the whipstock.

* * * * *